US008030255B2

(12) United States Patent
Matsui et al.

(10) Patent No.: US 8,030,255 B2
(45) **Date of Patent: *Oct. 4, 2011**

(54) LUBRICATING OIL COMPOSITION

(75) Inventors: Shigeki Matsui, Yokohama (JP); Hitoshi Komatsubara, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 645 days.

This patent is subject to a terminal disclaimer.

(21) Appl. No.: 11/757,109

(22) Filed: Jun. 1, 2007

(65) Prior Publication Data

US 2007/0287643 A1 Dec. 13, 2007

(30) Foreign Application Priority Data

Jun. 8, 2006 (JP) ..... 2006-159332

(51) Int. Cl.
*C10M 141/00* (2006.01)
*C10M 157/00* (2006.01)
*C10M 171/02* (2006.01)

(52) U.S. Cl. ..... 508/287; 508/192; 508/433; 508/460; 508/518; 508/591; 208/18; 208/19

(58) Field of Classification Search ..... 508/363, 508/189, 192, 118, 346; 208/18, 19; 585/1
See application file for complete search history.

(56) References Cited

U.S. PATENT DOCUMENTS 3,853,772 A 12/1974 Adams
3,904,537 A 9/1975 Ripple
4,089,790 A 5/1978 Adams
4,216,100 A 8/1980 Yaffe
4,263,152 A 4/1981 King et al.
4,272,387 A 6/1981 King et al.
4,497,719 A 2/1985 King et al.
4,761,482 A 8/1988 Karol
5,064,546 A 11/1991 Dasai
5,164,102 A 11/1992 Everett et al.
5,354,484 A 10/1994 Schwind et al.
5,358,650 A 10/1994 Srinivasan et al.
5,552,068 A 9/1996 Griffith
5,571,445 A 11/1996 Srinivasan et al.
5,595,964 A 1/1997 Bardasz
5,703,022 A 12/1997 Floyd
5,739,088 A 4/1998 Inoue et al.
5,744,430 A 4/1998 Inoue et al.
5,792,731 A 8/1998 Ichihashi et al.
5,817,605 A 10/1998 Papay
6,001,780 A 12/1999 Ho et al.
6,054,418 A 4/2000 Lacome et al.
6,114,288 A 9/2000 Fujitsu et al.
6,136,759 A 10/2000 Takagi et al.
6,147,035 A 11/2000 Sougawa et al.
6,232,275 B1 5/2001 Ichihashi et al.
6,303,546 B1 10/2001 Hata et al.
6,306,801 B1 10/2001 Yagishita et al.
6,310,010 B1 10/2001 Higton et al.
6,323,162 B1 11/2001 Yasunori et al.
6,451,745 B1 9/2002 Ward
6,534,450 B1 3/2003 Harrison et al.
6,569,818 B2 5/2003 Nakazato et al.
6,569,819 B2 5/2003 Yagishita et al.
6,593,281 B2 7/2003 Sato et al.
6,613,722 B1 9/2003 Watts et al.
6,617,286 B2 9/2003 Sato et al.
6,632,781 B2 10/2003 Harrison et al.
6,638,897 B2 10/2003 Ogano et al.
6,720,293 B2 4/2004 Bovington et al.
6,737,387 B2 5/2004 Harrison et al.
6,756,346 B1 6/2004 Baba et al.
6,815,401 B2 11/2004 Nakamura
6,828,285 B2 12/2004 Nakamura
6,828,286 B2 12/2004 Komiya et al.
6,841,521 B2 1/2005 Boffa et al.
6,855,675 B1 2/2005 Yamada et al.

(Continued)

FOREIGN PATENT DOCUMENTS

EP 0281992 A2 9/1988

(Continued)

OTHER PUBLICATIONS

Office Action dated Jan. 14, 2009 in U.S. Appl. No. 10/800,949.
Office Action dated May 2, 2008 in U.S. Appl. No. 10/800,949.
Office Action dated Oct. 31, 2007 in U.S. Appl. No. 10/800,949.
Office Action dated Apr. 3, 2007 in U.S. Appl. No. 10/800,949.
Office Action dated Dec. 1, 2009 in U.S. Appl. No. 11/933,634.
Office Action dated May 21, 2009 in U.S. Appl. No. 11/933,634.
Int'l Search Report issued on Jun. 9, 2009 in Int'l Application No. PCT/JP2009/001457.
Int'l Search Report issued on Nov. 5, 2002 in Int'l Application No. PCT/JP02/09122.
Int'l Preliminary Report on Patentability issued on Aug. 29, 2003 in Int'l Application No. PCT/JP02/09122.
Int'l Search Report issued on Nov. 5, 2002 in Int'l Application No. PCT/JP02/09123.
Int'l Preliminary Examination Report issued on Aug. 29, 2003 in Int'l Application No. PCT/JP02/09123.

(Continued)

*Primary Examiner* — Ellen McAvoy
*Assistant Examiner* — Pamela H Weiss
(74) *Attorney, Agent, or Firm* — Panitch Schwarze Belisario & Nadel LLP

(57) ABSTRACT

The present invention provides lubricating oil compositions having excellent anti-wear properties and anti-fatigue properties as well as excellent low temperature fluidity, particularly suitable for automatic transmissions and/or continuously variable transmissions, and internal combustion engines. The compositions comprises (A) a base oil with a kinematic viscosity at 100° C. of 1 to 8 $mm^2/s$, a pour point of −15° C. or lower, an aniline point of 100° C. or higher, the saturates of the base oil containing 40 percent by mass or more of paraffins, 25 percent by mass or less of one ring naphthenes, and 35 percent by mass or less of two to six ring naphthenes, as the main component, and (B) 0.005 to 0.4 percent by mass of a metallic detergent, (C) 0.005 to 0.2 percent by mass in terms of nitrogen of a succinimide-type ashless dispersant, (D) 0.005 to 0.2 percent by mass in terms of phosphorus of a phosphorus-containing anti-wear agent, and (E) 0.01 to 20 percent by mass of a viscosity index improver with a weight average molecular weight (Mw) of 50,000 or greater, on the basis of the total amount of the composition.

8 Claims, No Drawings

U.S. PATENT DOCUMENTS

| | | | | |
|---|---|---|---|---|
| 7,018,958 | B2 | 3/2006 | Arrowsmith et al. | |
| 7,026,273 | B2 | 4/2006 | Robson et al. | |
| 7,371,710 | B2 | 5/2008 | Morita | |
| 2001/0034305 | A1 | 10/2001 | Komatsubara | |
| 2001/0044389 | A1* | 11/2001 | Komiya et al. | 508/284 |
| 2002/0002120 | A1* | 1/2002 | Gahagan | 508/396 |
| 2002/0142922 | A1 | 10/2002 | Yagishita et al. | |
| 2003/0013619 | A1 | 1/2003 | Sato et al. | |
| 2004/0005988 | A1 | 1/2004 | Watanabe et al. | |
| 2004/0110647 | A1* | 6/2004 | Gapinski | 508/468 |
| 2004/0171500 | A1 | 9/2004 | Morita | |
| 2004/0176258 | A1 | 9/2004 | Morita | |
| 2004/0176260 | A1* | 9/2004 | Shirahama et al. | 508/291 |
| 2004/0192562 | A1 | 9/2004 | Morita | |
| 2005/0026790 | A1 | 2/2005 | Komatsubara et al. | |
| 2005/0101494 | A1 | 5/2005 | Iyer et al. | |
| 2005/0130855 | A1 | 6/2005 | Yagishita | |
| 2005/0261147 | A1* | 11/2005 | Rosenbaum et al. | 508/466 |
| 2006/0100467 | A1* | 5/2006 | Holmes et al. | 585/1 |
| 2006/0111255 | A1* | 5/2006 | Shirahama et al. | 508/469 |
| 2006/0131210 | A1* | 6/2006 | Rosenbaum et al. | 208/18 |
| 2006/0135378 | A1 | 6/2006 | Takahashi et al. | |
| 2006/0172898 | A1 | 8/2006 | Roby et al. | |
| 2006/0201852 | A1 | 9/2006 | Rosenbaum et al. | |
| 2007/0287643 | A1 | 12/2007 | Matsui et al. | |
| 2008/0026967 | A1 | 1/2008 | Suda et al. | |
| 2008/0110799 | A1 | 5/2008 | Matsui et al. | |
| 2009/0275491 | A1 | 11/2009 | Komatsubara et al. | |
| 2011/0034358 | A1 | 2/2011 | Komatsubara | |

FOREIGN PATENT DOCUMENTS

| | | | |
|---|---|---|---|
| EP | 0 686 689 | A2 | 12/1995 |
| EP | 0695798 | A2 | 2/1996 |
| EP | 0882781 | A2 | 12/1998 |
| EP | 1104800 | A2 | 6/2001 |
| EP | 1136544 | A1 | 9/2001 |
| GB | 2 360 528 | A | 9/2001 |
| JP | 56-10591 | A | 2/1981 |
| JP | 5610591 | A | 2/1981 |
| JP | 63223094 | A | 9/1988 |
| JP | 11-050077 | A | 6/1989 |
| JP | 04036391 | A | 2/1992 |
| JP | 06184578 | A | 7/1994 |
| JP | 07-268375 | A | 10/1995 |
| JP | 8302378 | A | 11/1996 |
| JP | 09-003463 | A | 1/1997 |
| JP | 93463 | A | 1/1997 |
| JP | 09-111275 | A | 4/1997 |
| JP | 10025487 | A | 1/1998 |
| JP | 10306292 | A | 11/1998 |
| JP | 1150077 | | 2/1999 |
| JP | 11-181464 | A | 7/1999 |
| JP | 11-286696 | | 10/1999 |
| JP | 11-293266 | A | 10/1999 |
| JP | 11269477 | A | 10/1999 |
| JP | 2000-001682 | A | 1/2000 |
| JP | 2000-063869 | A | 2/2000 |
| JP | 2000034491 | A | 2/2000 |
| JP | 2000063878 | A | 2/2000 |
| JP | 2000109867 | A | 4/2000 |
| JP | 2000109872 | A | 4/2000 |
| JP | 2000109875 | A | 4/2000 |
| JP | 2000256690 | A | 9/2000 |
| JP | 2000319682 | A | 11/2000 |
| JP | 2000355695 | A | 12/2000 |
| JP | 2001164283 | A | 6/2001 |
| JP | 2001279286 | A | 10/2001 |
| JP | 2001279287 | A | 10/2001 |
| JP | 2001323292 | A | 11/2001 |
| JP | 2001-342486 | A | 12/2001 |
| JP | 2002003875 | A | 1/2002 |
| JP | 2002129182 | A | 5/2002 |
| JP | 2002275488 | A | 9/2002 |
| JP | 2002-294271 | A | 10/2002 |
| JP | 2002544372 | A | 12/2002 |
| JP | 2003-041283 | A | 2/2003 |
| JP | 200382376 | A | 3/2003 |
| JP | 2003-514099 | A | 4/2003 |
| JP | 2003113391 | A | 4/2003 |
| JP | 2003321695 | A | 11/2003 |
| JP | 2004010799 | A | 1/2004 |
| JP | 2004-262979 | A | 9/2004 |
| JP | 2004-277712 | A | 10/2004 |
| JP | 200382377 | A | 10/2004 |
| JP | 2004331721 | A | 11/2004 |
| JP | 20058695 | | 1/2005 |
| JP | 2005139446 | A | 6/2005 |
| WO | 9637585 | A1 | 11/1996 |
| WO | 9714773 | A1 | 4/1997 |
| WO | 9826030 | A1 | 6/1998 |
| WO | 9931113 | A1 | 6/1999 |
| WO | 0070001 | A1 | 11/2000 |
| WO | 01/34735 | A1 | 5/2001 |
| WO | WO 02070636 | A1 * | 9/2002 |
| WO | 2004/069967 | A1 | 8/2004 |
| WO | 2005/095556 | A1 | 10/2005 |

OTHER PUBLICATIONS

Office Action issued Aug. 22, 2006 in U.S. Appl. No. 10/797,386.
Office Action issued May 18, 2007 in U.S. Appl. No. 10/797,386.
Office Action issued Sep. 7, 2006 in U.S. Appl. No. 10/797,387.
Office Action issued Apr. 12, 2007 in U.S. Appl. No. 10/797,387.
Office Action issued Jan. 9, 2008 in U.S. Appl. No. 10/797,387.
Office Action issued Apr. 3, 2007 in U.S. Appl. No. 10/816,274.
Office Action issued Jan. 9, 2008 in U.S. Appl. No. 10/816,274.
Office Action issued Sep. 22, 2008 in U.S. Appl. No. 10/816,274.
Office Action issued Apr. 10, 2009 in U.S. Appl. No. 10/816,274.
Int'l Search Report issued on Dec. 24, 2002 in Int'l Application No. PCT/JP02/10279.
Office Action issued Nov. 1, 2010 in U.S. Appl. No. 12/092,412.

* cited by examiner

LUBRICATING OIL COMPOSITION

The present invention relates to lubricating oil compositions having excellent anti-wear properties and anti-fatigue properties as well as excellent low temperature fluidity and in particular to those suitable for automatic transmissions and/or continuously variable transmissions, and internal combustion engines.

BACKGROUND OF THE INVENTION

A lubricating oil used for automatic transmissions or continuously variable transmissions or internal combustion engines has been required to be improved in various durabilities such as thermal oxidation stability, anti-wear properties, and anti-fatigue properties and low temperature viscosity characteristics such as low temperature viscosity reduction and low temperature fluidity improvement. In order to improve these properties, a lubricating oil has been used, which comprises a base oil blended with various additives such as anti-oxidants, detergent dispersants, anti-wear agents, friction modifiers, seal swelling agents, viscosity index improvers, anti-foaming agents, and dyes.

Recent transmissions and engines have been demanded to be light and small and increased in power output, and in particular transmissions have been sought to be improved in power transmission capability in connection with the increased power output of the engines with which the transmissions are used in combination. Therefore, the lubricating oil used for such transmissions and engines have been required to have properties to prevent wear or fatigue on the surfaces of the bearings and gears while maintaining a higher level of lubricating performance. Continuously variable transmissions are also increased in torque transmitted between the metal pulleys and metal belt due to the increased power output of the engines. Therefore, the lubricating oil used for such transmissions have been required to have properties to prevent wear or fatigue on the metal surfaces. Further, automatic transmissions and continuously variable transmissions are supposed to be used in a cold region of −10° C. or lower and are thus required to be further improved in low temperature performances so as to enhance the low temperature startability and improve the fuel efficiency at low temperatures. Generally, the low temperature viscosity characteristics of a lubricating oil can be improved by reducing the viscosity of the base oil or final product. However, it is known that a reduction in the base oil viscosity degrades the anti-wear properties and anti-fatigue properties. The development of a lubricating oil has been eagerly desired which has both low temperature viscosity characteristics and anti-wear properties or anti-fatigue properties.

It has been known that an attempt to improve both fatigue life and low temperature characteristics were made using a base oil with a good low temperature performance or a base oil with a high viscosity in combination, or blending a phosphorus- or sulfur-based extreme pressure additive in a suitable amount (see, for example, Japanese Patent Laid-Open Publication Nos. 2004-262979, 11-286696, and 2003-514099).

However, the foregoing fails to attain all viscosity temperature characteristics and low temperature performance, and metal fatigue life sufficiently. Therefore, it has been demanded to develop a lubricating oil composition having all of these performance characteristics but having no problem in other performances.

BRIEF SUMMARY OF THE INVENTION

In view of the above-described circumstances, the present invention has an object to provide a lubricating oil composition which is excellent in viscosity temperature characteristics and low temperature performance and also excellent in metal fatigue life, particularly suitable for automatic transmissions and/or continuously variable transmissions.

As a result of the extensive studies carried out by the inventors of the present invention, the present invention was accomplished on the basis of the finding that a lubricating oil composition comprising a specific base oil and specific additives are excellent in viscosity temperature characteristics and low temperature performance and can be improved in anti-wear properties and metal fatigue life.

That is, the present invention relates to a lubricating oil composition comprising (A) a base oil with a kinematic viscosity at 100° C. of 1 to 8 $mm^2/s$, a pour point of −15° C. or lower, an aniline point of 100° C. or higher, the saturates of the base oil containing 40 percent by mass or more of paraffins, 25 percent by mass or less of one ring naphthenes, and 35 percent by mass or less of two to six ring naphthenes, as the main component, and (B) 0.005 to 0.4 percent by mass of a metallic detergent, (C) 0.005 to 0.2 percent by mass in terms of nitrogen of a succinimide-type ashless dispersant, (D) 0.005 to 0.2 percent by mass in terms of phosphorus of a phosphorus-containing anti-wear agent, and (E) 0.01 to 20 percent by mass of a viscosity index improver with a weight average molecular weight (Mw) of 50,000 or greater, on the basis of the total amount of the composition.

The lubricating oil composition of the present invention is excellent in viscosity temperature characteristics and low temperature performance, as well as metal fatigue life. Therefore, the lubricating oil composition is particularly suitable for the automatic transmissions and/or continuously variable transmissions of automobiles, construction machinery, and agricultural machinery. Further, the lubricating oil composition may be suitably used as a lubricating oil for the manual transmissions and differential gears of automobiles, construction machinery, and agricultural machinery. Other than these usages, the lubricating oil composition may be suitably used as a gear oil for industrial use, a lubricating oil for the gasoline engines, diesel engines, and gas engines of automobiles such as two- and four-wheeled vehicles, power generators, and ships, a turbine oil, and a compressor oil.

DETAILED DESCRIPTION OF THE INVENTION

The present invention will be described in more detail below.

Component (A) of the lubricating oil composition of the present invention is a lubricating base oil with a kinematic viscosity at 100° C. of 1 to 8 $mm^2/s$, a pour point of −15° C. or lower, and an aniline point of 100° C. or higher, the saturates of which base oil contains 40 percent by mass or more of paraffins, 25 percent by mass or less of one ring naphthenes, and 35 percent by mass or less of two to six ring naphthenes.

Component (A) has a kinematic viscosity at 100° C. of 1 to 8 $mm^2/s$. More specifically, Component (A) is preferably any one of or a mixture of any two or more types selected from (A1) base oils with a kinematic viscosity at 100° C. of 1 or greater and less than 3.5 $mm^2/s$, preferably 1.5 to 3.4 $mm^2/s$ and (A2) base oils with a kinematic viscosity at 100° C. of 3.5 to 8 $mm^2/s$, preferably 3.7 to 7 $mm^2/s$, and more preferably of 3.9 to 5 $mm^2/s$ and is desirously adjusted in kinematic viscosity at 100° C. within a range of preferably 2 to 6 $mm^2/s$, more preferably 3 to 4.5 $mm^2/s$. Component (A) with a kinematic viscosity at 100° C. of greater than 8 $mm^2/s$ is not preferable because the resulting lubricating oil composition would be poor in low temperature viscosity characteristics while Component (A) with a kinematic viscosity at 100° C. of less than 1 $mm^2/s$ is not also preferable because the resulting lubricating oil composition would be poor in lubricity due to its insufficient oil film formation at lubricating sites and large in evaporation loss of the lubricating base oil.

The pour point of Component (A) is −15° C. or lower, preferably −17.5° C. or lower. There is no particular restriction on the lower limit of the pour point. However, the lower limit is preferably −45° C. or higher, more preferably −30° C. or higher, more preferably −27.5° C. or higher in view of the low temperature viscosity characteristics and economical efficiency of a dewaxing process. The pour point of Component (A1) is −15° C. or lower, preferably −20° C. or lower and preferably −45° C. or higher, more preferably −30° C. or higher, more preferably −25° C. or higher. The pour point of Component (A2) is −15° C. or lower, preferably −17.5° C. or lower and preferably −30° C. or higher, more preferably −25° C. or higher, more preferably −20° C. or higher. The use of Component (A) with a pour point of −15° C. or lower renders it possible to produce a lubricating oil composition with excellent low temperature viscosity characteristics. The dewaxing process may be either solvent dewaxing or catalytic dewaxing. However, the dewaxing process is preferably a catalytic dewaxing process because the lower temperature viscosity characteristics can be further improved even though the pour point is made lower than the more preferable lower limit.

The aniline point of Component (A) is preferably 100° C. or higher, more preferably 104° C. or higher, more preferably 108° C. or higher because it is rendered possible to produce a lubricating oil composition with excellent low temperature viscosity characteristics and fatigue life. There is no particular restriction on the upper limit. As one embodiment of the present invention, the aniline point may be 120° C. or higher. However, the aniline point is preferably 120° C. or lower in view of excellent solubility of additives and sludge and excellent compatibility with a sealing material.

The paraffin content in the saturates of Component (A) is 40 percent by mass or more, preferably 47 percent by mass or more with the objective of improving low temperature viscosity characteristics and fatigue life. There is no particular restriction on the upper limit of the paraffin content. As one embodiment of the present invention, the paraffin content may be 70 percent by mass or more. The paraffin content is preferably 70 percent by mass or less in view of excellent solubility of additives and sludge and more preferably 65 percent by mass or less, more preferably 60 percent by mass or less, particularly preferably 57 percent by mass or less in view of more excellent low temperature viscosity characteristics.

The naphthene content (one to six ring naphthene content) in the saturates of

Component (A) is 60 percent by mass or less, preferably 53 percent by mass or less, correspondingly to the foregoing paraffin content. There is no particular restriction on the lower limit of the naphthene content. As one embodiment of the present invention, the naphthene content may be 30 percent by mass or less. However, the naphthene content is preferably 30 percent by mass or more in view of excellent solubility of additives and sludge and more preferably 35 percent by mass or more, more preferably 40 percent by mass or more, more preferably 43 percent by mass or more in view of more excellent low temperature viscosity characteristics.

The one ring naphthene content in the saturates of Component (A) is 25 percent by mass or less, preferably 23 percent by mass or less. There is no particular restriction on the lower limit. As one embodiment of the present invention, the one ring naphthene content may be less than 10 percent by mass. However, the one ring naphthene content is preferably 10 percent by mass or more, more preferably 15 percent by mass or more, more preferably 18 percent by mass or more in view of excellent solubility of additives and sludge.

The two to six ring naphthene content in the saturates of Component (A) is 35 percent by mass or less, preferably 32 percent by mass or less. There is no particular restriction the lower limit. As one embodiment of the present invention, the two to six ring naphthene content may be less than 10 percent by mass. However, the two to six ring naphthene content is preferably 10 percent by mass or more, more preferably 20 percent by mass or more, more preferably 25 percent by mass or more in view of excellent solubility of additives and sludge.

There is no particular restriction on the total amount of the paraffin and one ring naphthene contents in the saturates of Component (A). However, the total amount is preferably 50 percent by mass or more, more preferably 60 percent by mass or more, more preferably 65 percent by mass or more, particularly preferably 68 percent by mass or more. As one embodiment of the present invention, the total amount may be 90 percent by mass or more. However, the total amount is preferably 90 percent by mass or less, more preferably 80 percent by mass or less, more preferably 76 percent by mass or less in view of excellent solubility of additives and sludge.

There is no particular restriction on the ratio of the paraffin content to one ring naphthene content in the saturates of Component (A) (paraffin content/one ring naphthene content). As one embodiment of the present invention, the ratio may be 10 or greater. However, the ratio is preferably 10 or less in view of excellent solubility of additives and sludge and more preferably 5 or less, more preferably 3.5 or less, particularly preferably 3.0 or less in view of excellent low temperature viscosity characteristics.

The paraffin and naphthene contents in the saturates used herein denotes the alkane content (unit: percent by mass) and naphthene content (object to be measured: one to six ring naphthenes, unit: percent by mass) measured in accordance with ASTM D 2786-91.

There is no particular restriction on the % $C_A$ of Component (A). However, the % $C_A$ is 2 or less, preferably 1 or less, more preferably 0.5 or less, particularly preferably 0.2 or less with the objective of enhancing thermal/oxidation stability and viscosity temperature characteristics.

There is no particular restriction on the % $C_P$ of Component (A). However, the % $C_P$ is preferably 70 or greater, more preferably 75 or greater, more preferably 80 or greater with the objective of enhancing thermal/oxidation stability and viscosity temperature characteristics. There is no particular restriction on the upper limit of the % $C_P$. As one embodiment of the present invention, the % $C_P$ may be 90 or greater. However, the % $C_P$ is preferably 90 or less, more preferably 85 or less in view of excellent solubility of additives and sludge.

There is no particular restriction on the % $C_N$ of Component (A). The % $C_N$ is preferably 28 or less, more preferably 25 or less with the objective of enhancing thermal/oxidation stability and viscosity-temperature characteristics. There is no particular restriction on the lower limit of the % $C_N$. As one embodiment of the present invention, the % $C_N$ may be less than 10. However, the % $C_N$ is preferably 10 or greater, more preferably 15 or greater in view of excellent solubility of additives and sludge.

There is no particular restriction on the % $C_P$/% $C_N$ of Component (A). The % $C_P$/% $C_N$ is preferably 2 or greater, more preferably 2.4 or greater with the objective of further enhancing thermal/oxidation stability and viscosity temperature characteristics. There is no particular restriction on the upper limit of the % $C_P$/% $C_N$. As one embodiment of the present invention, the % $C_P$/% $C_N$ may be 5 or greater. However, the % $C_P$/% $C_N$ is preferably 5 or less, more preferably 4.5 or less in view of excellent solubility of additives and sludge.

The % $C_A$, % $C_P$, and % $C_N$ used herein denote the percentages of the aromatic carbon number in the total carbon number, the paraffin carbon number in the total carbon number, and the naphthene carbon number in the total carbon number, respectively, determined by a method (n-d-M ring analysis) in accordance with ASTM D 3238-85.

There is no particular restriction on the saturate content in Component (A). However, the content is preferably 90 percent by mass or more, more preferably 94 percent by mass or more, more preferably 98 percent by mass or more, particularly preferably 99 percent by mass or more, with the objective of further enhancing thermal/oxidation stability and viscosity temperature characteristics.

There is no particular restriction on the aromatic content in Component (A). However, the aromatic content is preferably 10 percent by mass or less, more preferably 6 percent by mass or less, more preferably 2 percent by mass or less, particularly preferably 1 percent by mass or less, with the objective of further enhancing thermal/oxidation stability and viscosity-temperature characteristics.

The saturate and aromatic contents used herein denote the values (unit: percent by mass) measured in accordance with ASTM D 2007-93.

There is no particular restriction on the sulfur content in Component (A). However, the sulfur content is preferably 0.1 percent by mass or less, more preferably 0.05 percent by mass or less, more preferably 0.01 percent by mass or less.

There is no particular restriction on the nitrogen content in Component (A). However, the nitrogen content is preferably 5 ppm by mass or less, more preferably 3 ppm by mass or less because it is rendered possible to produce a lubricating oil composition with more excellent thermal/oxidation stability.

There is no particular restriction on the viscosity index of Component (A). However, the viscosity index is preferably 100 or greater, more preferably 105 or greater. As one embodiment of the present invention, the viscosity index may be 135 or greater. However, the viscosity index is preferably 135 or less, more preferably 130 or less in view of more excellent solubility of additives and sludge. The viscosity index of Component (A1) is preferably from 100 to 120, more preferably from 105 to 115 while the viscosity index of Component (A2) is preferably from 120 to 135, more preferably from 120 to 130.

There is no particular restriction on the NOACK evaporation loss of Component (A). However, the NOACK evaporation loss is preferably from 2 to 70 percent by mass, more preferably from 5 to 50 percent by mass. The NOACK evaporation loss of Component (A1) is preferably from 20 to 70 percent by mass, more preferably from 25 to 50 percent by mass. Further, selection of Component (A1) with a NOACK evaporation loss of 30 to 40 percent by mass is particularly preferable with the objective of improving low temperature viscosity characteristics, anti-wear properties and fatigue life in a well balanced manner. The NOACK evaporation loss of Component (A2) is preferably from 2 to 25 percent by mass, more preferably 5 to 20 percent by mass. Further, selection of Component (A2) with a NOACK evaporation loss of 10 to 15 percent by mass is particularly preferable with the objective of improving low temperature viscosity characteristics, anti-wear properties and fatigue life in a well balanced manner. When Components (A1) and (A2) are used in combination, the NOACK evaporation loss of the mixture is preferably from 15 to 50 percent by mass, more preferably from 20 to 40 percent by mass and for the same reason as above particularly preferably from 25 to 35 percent by mass. The NOACK evaporation loss used herein denotes the evaporation loss measured in accordance with ASTM D 5800-95.

There is no particular restriction on the method of producing Component (A) as long as the above-described properties are attained. However, specifically, preferred examples of the lubricating base oil used in the present invention include those produced by subjecting a feedstock selected from the following base oils (1) to (8) and/or a lubricating oil fraction recovered therefrom to a given refining process and recovering the lubricating oil fraction:

(1) a distillate oil produced by atmospheric distillation of a paraffin base crude oil and/or a mixed base crude oil;

(2) a whole vacuum gas oil (WVGO) produced by vacuum distillation of an atmospheric distillation bottom from a paraffin base crude oil and/or a mixed base crude oil;

(3) a wax obtained by a lubricating oil dewaxing process (slack wax) and/or a synthetic wax produced by a gas to liquid (GTL) process (Fischer-Tropsch wax, GTL wax);

(4) one or a mixed oil of two or more oils selected from the base oils (1) to (3) above and/or a mild-hydrocracked oil of the mixed oil;

(5) a mixed oil of two or more oils selected from the base oils (1) to (4) above;

(6) a deasphalted oil (DAO) obtained by deasphalting the base oil of (1), (2) (3), (4) or (5);

(7) an oil obtained by mild-hydrocracking (MHC) the base oil (6); and (8) a mixed oil of two or more oils selected from the base oils (1) to (7).

Examples of the above-mentioned process include hydrorefining processes such as hydrocracking and hydrofinishing, solvent refining such as furfural solvent extraction, dewaxing such as solvent dewaxing and catalytic dewaxing, clay refining with acid clay or active clay, and chemical (acid or alkali) treating such as sulfuric acid treating and sodium hydroxide treating. In the present invention, any one or more of these refining processes may be used. When two or more of these refining processes are used in combination, there is no particular restriction on the order thereof. Therefore, the refining processes may be carried out in any order.

The lubricating base oil used in the present invention is particularly preferably the following base oil (9) or (10) produced by subjecting a base oil selected from the above-described base oils (1) to (8) or a lubricating oil fraction recovered therefrom to a specific treatment:

(9) a hydrocracked mineral oil produced by hydrocracking a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation; or

(10) a hydroisomerized mineral oil produced by hydroisomerizing a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation.

Particularly preferably, the dewaxing treatment carried out upon production of the lubricating base oil (9) or (10) includes a catalytic dewaxing treatment with the objectives of further enhancing the thermal/oxidation stability, low temperature viscosity characteristics, and anti-fatigue properties of the resulting lubricating oil composition.

If necessary, a solvent refining process and/or a hydrofinishing process may be carried out upon production of the lubricating base oil (9) or (10).

There is no particular restriction on the catalyst used in the above-described hydrocracking and hydroisomerizing. However, the catalyst is preferably a hydrocracking catalyst comprising any one of complex oxides having cracking activity (for example, silica-alumina, alumina boria, or silica zirconia) or one or more types of such complex oxides bound with a binder, used as a support and a metal with hydrogenation capability (for example, one or more types of metals of Groups VIa and VIII of the periodic table) supported on the support, or a hydroisomerizing catalyst comprising a support containing zeolite (for example, ZSM-5, zeolite beta, or SAPO-11) and a metal with hydrogenation capability, containing at least one or more types of metals of Group VIII of the periodic table and supported on the support. The hydrocracking and hydroisomerizing catalysts may be laminated or mixed so as to be used in combination.

There is no particular restriction on the conditions under which the hydrocracking and hydroisomerizing are carried out. Preferably, the hydrogen partial pressure is from 0.1 to 20 MPa, the average reaction temperature is from 150 to 450° C., the LHSV is from 0.1 to 3.0 $hr^{-1}$, and the hydrogen/oil ratio is from 50 to 20000 scf/bbl.

The catalytic dewaxing is carried out by reacting a hydrocracked or hydroisomerized oil with hydrogen under conditions effective in reducing the pour point of the oil in the presence of a suitable dewaxing catalyst. The catalytic dewaxing renders it possible to produce two or more types of lubricating base oils by converting a part of the high boiling point substance in the hydrocracked/hydroisomerized product to a low boiling point substance, separating the low boiling point substance from the heavier base oil fraction, and distilling the base oil fraction. The separation of the low boiling point substance may be carried out before obtaining the intended lubricating base oil or during the distillation.

There is no particular restriction on the dewaxing catalyst as long as it can decrease the pour point of the hydrocracked/hydroisomerized oil. However, preferably the catalyst can produce the intended lubricating base oil from the hydrocracked/hydroisomerized oil at a high yield. Preferred examples of such a dewaxing catalyst include shape-selective molecular sieves, more specifically ferrierite, mordenite, ZSM-5, ZSM-11, ZSN-23, ZSM-35, ZSM-22 (also referred to as Theta-1 or TON), and silico-alumino-phosphates (SAPO). The molecular sieves are used in combination with preferably a catalytic metal component, more preferably a precious metal. Preferred combination include complexes of for example platinum and H-mordenite.

There is no particular restriction on the dewaxing conditions. However, preferably the temperature is from 200 to 500° C., and the hydrogen pressure is from 10 to 200 bar (1 MPa to 20 MPa). When a flow-through reactor is used, the $H_2$ treating rate is preferably from 0.1 to 10 kg/l/hr, and the LHSV is preferably from 0.1 to 10 $h^{-1}$, more preferably from 0.2 to 2.0 $h^{-1}$. The dewaxing is preferably carried out so that usually 40 percent by mass or less, preferably 30 percent by mass or less of a substance with an initial boiling point of 350 to 400° C., contained in the hydrocracked/hydroisomerized oil is converted to a substance with a boiling point lower than the initial boiling point.

The lubricating oil composition of the present invention may contain a mineral base oil and/or a synthetic base oil (excluding Component (A)) used in a conventional lubricating oil, in combination with Component (A) as long as the composition contains Component (A) as the main component. In this case, the content of Component (A) is preferably from 50 to 99 percent by mass, more preferably from 70 to 97 percent by mass, more preferably from 85 to 95 percent by mass, on the basis of the total amount of the composition.

Specific examples of the mineral oil include those which can be obtained by subjecting a lubricating oil fraction produced by vacuum-distilling an atmospheric distillation bottom oil resulting from atmospheric distillation of a crude oil, to any one or more treatments selected from solvent deasphalting, solvent extraction, hydrocracking, hydroisomerization, solvent dewaxing, catalytic dewaxing, and hydrorefining; wax-isomerized mineral oils; and those obtained by isomerizing GTL WAX (Gas to Liquid Wax).

Examples of the synthetic lubricating base oil include polybutenes and hydrogenated compounds thereof; poly-α-olefins such as 1-octene oligomer and 1-decene oligomer, and hydrogenated compounds thereof; diesters such as ditridecyl glutarate, di-2-ethylhexyl adipate, diisodecyl adipate, ditridecyl adipate and di-2-ethylhexyl sebacate; polyol esters such as neopentyl glycol ester, trimethylolpropane caprylate, trimethylolpropane pelargonate, pentaerythritol-2-ethylhexanoate and pentaerythritol pelargonate; aromatic synthetic oils such as alkylnaphthalenes, alkylbenzenes, and aromatic esters; and mixtures of the foregoing.

Examples of the lubricating base oil which may be used in combination with Component (A) include the above-described mineral base oils and synthetic base oil and mixtures of two or more types selected from these base oils. For example, the base oil used in the present invention may be one or more of the mineral base oils or synthetic base oils or a mixed oil of one or more of the mineral base oils and one or more of the synthetic base oils.

Among these base oils, the lubricating base oil used in combination with Component (A) is preferably any of the above-described synthetic base oils, more preferably a poly-α-olefin base oil. There is no particular restriction on the kinematic viscosity at 100° C. of the synthetic base oils, in particular the poly-α-olefin base oils. Therefore, those with a kinematic viscosity at 100° C. of 1 to 20 $mm^2/s$ may be used. However, it is preferable to use those with a kinematic viscosity at 100° C. of preferably 1 to 8 $mm^2/s$, more preferably 1.5 to 6 $mm^2/s$, more preferably 1.5 to 4 $mm^2/s$, particularly preferably 1.5 to 2.5 $mm^2/s$ with the objective of further enhancing low temperature viscosity characteristics.

There is no particular restriction on the pour point of the synthetic base oils, in particular the poly-α-olefin base oils. The pour point is preferably from −10 to −60° C., more preferably from −30 to −55° C., more preferably from −40 to −50° C.

The content of the lubricating base oil used in combination with Component (A) in particular the poly-α-olefin base oil is preferably from 1 to 50 percent by mass, more preferably from 3 to 30 percent by mass, more preferably from 5 to 15 percent by mass on the basis of the total amount of the lubricating oil composition with the objective of enhancing the anti-fatigue properties and anti-wear properties, and low temperature viscosity characteristics in a well-balanced manner.

The lubricating base oil of the lubricating oil composition of the present invention is a lubricating base oil comprising Components (A) or a mixed base oil of Component (A) and the above-described mineral base oil or synthetic base oil. The lubricating base oil is preferably so adjusted that the kinematic viscosity at 100° C. is preferably from 2 to 8 $mm^2/s$, more preferably from 2.5 to 6 $mm^2/s$, more preferably from 3 to 3.8 $mm^2/s$ and the viscosity index is preferably 100 or greater, more preferably 105 or greater, more preferably 110 or greater.

Component (B) of the lubricating oil composition of the present invention is a metallic detergent. Specific examples of the metallic detergent include sulfonate, phenate, salicylate, and carboxylate detergents. It is preferred to use a sulfonate detergent with the objective of further enhancing torque capacity and shifting characteristics when the composition is used in an automatic transmission and/or a continuously variable transmission and use a salicylate detergent with the objective of producing a lubricating oil composition with excellent shifting characteristics and anti-shudder properties. Further, it is particularly preferred to use a sulfonate detergent and/or a salicylate detergent with the objective of enhancing these properties in a well-balanced manner.

There is no particular restriction on the structure of the sulfonate detergent. Examples of the sulfonate detergent include alkali metal or alkaline earth metal salts, particularly preferably magnesium and/or calcium salts, of alkyl aromatic sulfonic acids, obtained by sulfonating alkyl aromatic compounds having a molecular weight of 100 to 1,500, preferably 200 to 700. Specific examples of the alkyl aromatic sulfonic acids include petroleum sulfonic acids and synthetic sulfonic acids. The petroleum sulfonic acids may be those obtained by sulfonating an alkyl aromatic compound contained in the lubricant fraction of a mineral oil or may be mahogany acid by-produced upon production of white oil. The synthetic sulfonic acids may be those obtained by sulfonating an alkyl benzene having a straight-chain or branched alkyl group, produced as a by-product from a plant for producing an alkyl benzene used as the raw material of a detergent or obtained by alkylating polyolefin to benzene, or those obtained by sulfonating dinonylnaphthalene. There is no particular restriction on the sulfonating agent used for sulfonating these alkyl aromatic compounds. The sulfonating agent may be fuming sulfuric acids or sulfuric acid.

The alkaline earth metal sulfonates include not only neutral alkaline earth metal sulfonates produced by reacting the above-mentioned alkyl aromatic sulfonic acid directly with an alkaline earth metal base such as an oxide or hydroxide of an alkaline earth metal such as magnesium and/or calcium or produced by once converting the alkyl aromatic sulfonic acid to an alkali metal salt such as a sodium salt or a potassium salt and then substituting the alkali metal salt with an alkaline earth metal salt; but also basic alkaline earth metal sulfonates produced by heating such neutral alkaline earth metal salts and an excess amount of an alkaline earth metal salt or an alkaline earth metal base (hydroxide or oxide) in the presence of water; and carbonate overbased alkaline earth metal sulfonates and borate overbased alkaline earth metal sulfonates produced by reacting such neutral alkaline earth metal sulfonates with an alkaline earth metal base in the presence of carbonic acid gas and/or boric acid or borate.

The sulfonate detergent used in the present invention may be any of the above-described neutral, basic and overbased alkaline earth metal sulfonates and mixtures thereof.

The sulfonate detergent is preferably a calcium sulfonate detergent or a magnesium sulfonate detergent, particularly preferably a calcium sulfonate detergent because the resulting lubricating oil composition is excellent in an improvement in torque capacity when the composition is used in an automatic transmission and/or a continuously variable transmission.

Although sulfonate detergents are usually commercially available as diluted with a light lubricating base oil, it is preferred to use a sulfonate detergent whose metal content is from 1.0 to 20 percent by mass, preferably from 2.0 to 16 percent by mass.

The base number of the sulfonate detergent used in the present invention is optional and usually from 0 to 500 mgKOH/g. However, the base number is preferably from 100 to 450 mgKOH/g, more preferably from 200 to 400 mgKOH/g because the resulting lubricating oil composition will be excellent in an improvement in torque capacity.

The term "base number" used herein denotes the base number measured by the perchloric acid potentiometric titration method in accordance with section 7 of JIS K2501 "Petroleum products and lubricants-Determination of neutralization number".

There is no particular restriction on the structure of the salicylate detergent. However, the salicylate detergent is preferably a metal salt, preferably alkali metal or alkaline earth metal salt, particularly preferably magnesium and/or calcium salt of an salicylic acid having one or two alkyl groups having 1 to 30 carbon atoms.

The salicylate detergent used in the present invention is preferably an alkylsalicylic acid metal salt and/or an (overbased) basic salt thereof, the component ratios of which monoalkylsalicylic acid metal salt and dialkylsalicylic acid metal salt are from 85 to 100 percent by mole and from 0 to 15 percent by mole respectively, and the component ratio of which 3-alkylsalicylic acid metal salt is from 40 to 100 percent by mole, because the resulting lubricating oil composition can be further improved in anti-shudder durability when the composition is used in an automatic transmission and/or a continuously variable transmission.

The term "monoalkylsalicylic acid metal salt" used herein denotes an alkylsalicylic acid having one alkyl group, such as 3-alkylsalicylic acid metal salt, 4-alkylsalicylic acid metal salt, and 5-alkylsalicylic acid metal salt. The component ratio of the monoalkylsalicylic acid metal salt is from 85 to 100 percent by mole, preferably from 88 to 98 percent by mole, more preferably from 90 to 95 percent by mole, on the basis of 100 percent by mole of the alkylsalicylic acid metal salt. The component ratio of the alkylsalicylic acid metal salt other than monoalkylsalicylic acid metal salt, such as dialkylsalicylic acid metal salt is from 0 to 15 percent by mole, preferably from 2 to 12 percent by mole, more preferably from 5 to 10 percent by mole. The component ratio of the 3-alkylsalicylic acid metal salt is from 40 to 100 percent by mole, preferably from 45 to 80 percent by mole, more preferably from 50 to 60 percent by mole, on the basis of 100 percent by mole of the alkylsalicylic acid metal salt. The total component ratio of the 4-alkylsalicyclic acid metal salt and 5-alkylsalicylic acid metal salt corresponds to the component ratio of the alkylsalicylic acid metal salt excluding the 3-alkylsalicylic acid metal salt and dialkylsalicylic acid metal salt and is from 0 to 60 percent by mole, preferably from 20 to 50 percent by mole, more preferably from 30 to 45 percent by mole, on the basis of 100 percent by mole of the alkylsalicylic acid metal salt. Inclusion of a slight amount of the dialkylsalicylic acid metal salt renders it possible to produce a composition having both anti-wear properties and low temperature characteristics. The component ratio of the 3-alkylsalicylate of 40 percent by mole or more renders it possible to reduce relatively the component ratio of the 5-alkylsalicylic acid metal salt and thus enhance the oil solubility.

Examples of the alkyl group of the alkylsalicylic acid metal salt constituting the salicylate detergent include alkyl groups having 10 to 40, preferably 10 to 19 or 20 to 30, more preferably 14 to 18 or 20 to 26, particularly preferably 14 to 18 carbon atoms. Examples of alkyl groups having 10 to 40 carbon atoms include those such as decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and primary and secondary alkyl groups. However, secondary alkyl groups are preferable with the objective of easily producing the above-described desired salicylic acid metal salt.

Examples of the metal of the alkylsalicylic acid metal salt include alkali metals such as sodium and potassium, and alkaline earth metals such as calcium and magnesium. The metal is preferably calcium or magnesium, particularly preferably calcium.

There is no particular restriction on the method of producing the salicylate detergent used in the present invention which thus may be produced by any of the known methods. For example, an alkylsalicylic acid containing a monoalkylsalicylic acid as the main component is obtained by alkylating 1 mole of a phenol using 1 mole or more of an olefin having 10 to 40 carbon atoms, such as a polymer or copolymer of ethylene, propylene, or butene, preferably a straight-chain α-olefin such as an ethylene polymer, and then carboxylating the alkylated phenol using carbon dioxide gas, or alternatively by alkylating 1 mole of salicylic acid using 1 mole or more of such an olefin preferably such a straight-chain α-olefin. The alkylsalicylic acid is then reacted with a metal base such as an alkali metal or alkaline earth metal oxide or hydroxide or converted to an alkali metal salt such as sodium salt or potassium salt, which alkali metal salt may be further substituted with an alkaline earth metal. Particularly preferably, the reaction ratio of the phenol or salicylic acid to the olefin is adjusted to preferably 1:1 to 1.15 (molar ratio), more preferably 1:1.05 to 1.1 (molar ratio) because the component ratio of the monoalkylsalicylic acid metal salt to dialkylsalicylic acid metal salt is easily adjusted to the desired ratio required by the present invention. Further, particularly preferably a straight-chain α-olefin is used as the olefin because the component ratio of the 3-alkylsalicylic acid metal salt, 5-alkylsalicylic acid metal salt, or the like is easily adjusted to the desired ratio required by the present invention, and an alkylsalicylic acid metal salt having a secondary alkyl group which is preferable in the present invention can be obtained as the main component. The use of a branched olefin as the above-mentioned olefin is not preferable because only the 5-alkylsalicylic acid metal salt is easily obtainable, but it is necessary to improve the oil solubility by mixing the 3-alkylsalicylic acid metal salt so as to obtain a salicylate detergent with the structure desired by the present invention, making the process variable.

The salicylate detergent used in the present invention also includes basic salts produced by heating an alkali metal or alkaline earth metal salicylate (neutral salt) obtained as described above, and an excess amount of an alkali metal or alkaline earth metal salt or an alkali metal or alkaline earth metal base (hydroxide or oxide of an alkali metal or alkaline earth metal) in the presence of water; and overbased salts produced by reacting such a neutral salt with a base such as a hydroxide of an alkali metal or alkaline earth metal in the presence of carbonic acid gas and/or boric acid or borate.

These reactions are generally carried out in a solvent (aliphatic hydrocarbon solvents such as hexane, aromatic hydrocarbon solvents such as xylene, and light lubricating base oil). It is preferred to use a solvent whose metal content is within the range of 1.0 to 20 percent by mass, preferably 2.0 to 16 percent by mass.

Most preferable salicylate detergents used in the present invention are alkylsalicylic acid metal salts and/or (overbased) basic salts thereof, the component ratios of which monoalkylsalicylic acid metal salt and dialkylsalicylic acid metal salt are from 85 to 95 percent by mole and from 5 to 15 percent by mole respectively, and 3-alkylsalicylic acid metal salt, and 4-alkylsalicylic acid metal salt and 5-alkylsalicylic acid metal salt are from 50 to 60 percent by mole and from 35 to 45 percent by mole respectively, because the resulting lubricating oil composition will be excellent in initial anti-shudder properties when the composition is used in an automatic transmission and/or a continuously variable transmission. The alkyl group referred herein is particularly preferably a secondary alkyl group.

The base number of the salicylate detergent used in the present invention is usually from 0 to 500 mgKOH/g, preferably from 20 to 300 mgKOH/g, particularly preferably from 100 to 200 mgKOH/g. One or more of the salicylate detergents with a base number in these ranges may be used. The term "base number" used herein denotes a base number measured by the perchloric acid potentiometric titration method in accordance with section 7 of JIS K2501 "Petroleum products and lubricants-Determination of neutralization number".

Specific examples of the phenate detergent include alkaline earth metal salts, particularly magnesium salts and/or calcium salts, of an alkylphenolsulfide obtained by reacting an alkylphenol having at least one straight-chain or branched alkyl group having 4 to 30, preferably 6 to 18 carbon atoms with sulfur or a Mannich reaction product of an alkylphenol obtained by reacting such an alkylphenol with formaldehyde.

The base number of the phenate detergent is usually from 0 to 500 mgKOH/g, preferably from 20 to 450 mgKOH/g.

The content of Component (B) in the lubricating oil composition of the present invention is from 0.005 to 0.4 percent by mass, preferably from 0.01 to 0.3 percent by mass, more preferably from 0.04 to 0.25 percent by mass in terms of metal, on the basis of the total amount of the composition.

When the sulfonate detergent is used, the content thereof is preferably from 0.01 to 0.3 percent by mass, and more preferably from 0.03 to 0.3 percent by mass, more preferably from 0.1 to 0.25 percent by mass, in terms of metal on the basis of the total amount of the composition in view of excellent fatigue life and with the objective of further enhancing torque capacity and shifting characteristics.

When the salicylate detergent is used, the content thereof is preferably from 0.001 to 0.1 percent by mass, more preferably from 0.005 to 0.08 percent by mass, more preferably from 0.01 to 0.04 percent by mass in terms of metal on the basis of the total amount of the composition because a composition is obtainable which excels in fatigue life and in torque capacity, shifting characteristics, and anti-shudder properties in a well-balanced manner. When the salicylate detergent is used in combination with the sulfonate detergent, the content of the salicylate detergent is preferably from 0.005 to 0.05 percent by mass, more preferably from 0.008 to 0.02 percent by mass with the objectives of further enhancing anti-shudder properties and retaining torque capacity and shifting characteristics in a well balanced manner. The content of the sulfonate detergent when used in combination with the salicylate detergent is preferably from 0.01 to 0.3 percent by mass, more preferably from 0.02 to 0.2 percent by mass, more preferably from 0.03 to 0.15 percent by mass, particularly preferably from 0.04 to 0.1 percent by mass on the basis of the total amount of the lubricating oil composition of the present invention.

Component (C) of the lubricating oil composition of the present invention is a succinimide-type ashless dispersant.

Examples of the succinimide-type ashless dispersant include succinimides having in their molecules at least one alkyl or alkenyl group having preferably 40 to 400, more preferably 60 to 350 carbon atoms and derivatives obtained by modifying such succinimides with one or more compounds selected from boric acid, borate, monocarboxylic acids having 2 to 30 carbon atoms, such as fatty acid, polycarboxylic acids having 2 to 30 carbon atoms, such as oxalic acid, phthalic acid, trimellitic acid, and pyromellitic acid, phosphorus-containing acids such as phosphoric acid, phosphorus acid, acidic phosphorus or phosphoric acid esters, and sulfur-containing compounds. The succinimide may be of mono or bis type but is preferably of bis type.

The alkyl or alkenyl group having 40 to 400 carbon atoms may be straight-chain or branched but is preferably a branched alkyl or alkenyl group. Specific examples of the alkyl or alkenyl group include branched alkyl or alkenyl groups having 40 to 400, preferably 60 to 350 carbon atoms, derived from an oligomer of an olefin such as propylene, 1-butene, and isobutylene or from a cooligomer of ethylene and propylene. An alkyl or alkenyl group having fewer than 40 carbon atoms would be difficult in allowing the compound to exhibit an effect as an ashless dispersant, while an alkyl or alkenyl group having more than 400 carbon atoms would degrade the low-temperature fluidity of the resulting lubricating oil composition.

The succinimide-type ashless dispersant used in the present invention preferably contains a boron-containing succinimide in view of excellent anti-wear properties and anti-fatigue properties and is particularly preferably a combination of a boron-containing succinimide and a boron-free succinimide.

The content of Component (C) in the lubricating oil composition of the present invention is from 0.005 to 0.4 percent by mass, preferably from 0.01 to 0.2 percent by mass in terms of nitrogen on the basis of the total amount of the composition. When Component (C) contains a boron-containing succinimide, the content thereof is preferably from 0.001 to 0.2 percent by mass, more preferably from 0.005 to 0.08 percent by mass, more preferably from 0.01 to 0.05 percent by mass, particularly preferably from 0.015 to 0.025 percent by mass in terms of boron on the basis of the total amount of the composition. Whereby, it is rendered possible to produce a lubricating oil composition which is more excellent in anti-wear properties and anti-fatigue properties and improved in torque capacity, shifting characteristics, and anti-shudder properties in a well-balanced manner.

There is no particular restriction on the mass ratio of the boron content to nitrogen content (B/N ratio) resulting from the use of a succinimide-type ashless dispersant. However, the mass ratio is preferably from 0.05 to 1.2, more preferably from 0.1 to 1, more preferably from 0.1 to 0.5, more preferably from 0.15 to 0.3.

Component (D) of the lubricating oil composition of the present invention is a phosphorus-containing anti-wear agent.

There is no particular restriction on the phosphorus-containing anti-wear agent as long as it contains phosphorus in its molecules. Examples of the phosphorus-containing anti-wear agent include phosphoric acid, phosphorus acid, phosphoric acid monoesters, phosphoric acid diesters, phosphoric acid triesters, phosphorus acid monoesters, phosphorus acid diesters, phosphorus acid triesters, thiophosphoric acid moncesters, thiophosphoric acid diesters, thiophosphoric acid triesters, thiophosphorus acid monoesters, thiophosphorus acid diesters, and thiophosphorus acid triesters, each having a hydrocarbon group having 1 to 30 carbon atoms, salts of these esters and amines or alkanolamines, and metal salts such as zinc salt of these esters. Examples of the hydrocarbon group having 1 to 30 carbon atoms include alkyl, cycloalkyl, alkenyl, alkyl-substituted cycloalkyl, aryl, alkyl-substituted aryl, and arylalkyl groups. These hydrocarbon groups may have one element selected from nitrogen, sulfur, and oxygen in their molecules. One or more Component (D) may be blended in the lubricating oil composition of the present invention.

Preferred phosphorus-containing anti-wear agents are phosphoric or phosphorus acid esters having an alkyl group having 4 to 20 carbon atoms or an (alkyl)aryl group having 6 to 12 carbon atoms and one compound or a mixture of two or more compounds selected from amine salts obtained by allowing these esters to react with an alkylamine having an alkyl group having 1 to 18 carbon atoms. More preferred are one compound or a mixture of two more compounds selected from phosphorus acid esters having an alkyl group having 4 to 20 carbon atoms, such as dibutylphoshite and phosphorus acid esters having an (alkyl)aryl group having 6 to 12 carbon atoms, such as phenylphosphite. Particularly preferred are phosphorus acid diesters having an (alkyl) aryl group having 6 to 12 carbon atoms, such as diphenylphosphite.

The content of the phosphorus-containing anti-wear agent in the lubricating oil composition of the present invention is usually from 0.01 to 5 percent by mass and in terms of phosphorus preferably from 0.001 to 0.1 percent by mass, each on the basis of the total amount of the composition. Although the advantageous effects of the present invention are achieved even though the phosphorus-containing anti-wear agent is contained in a low concentration such as 0.005 percent by mass or less, the content thereof is preferably from 0.005 to 0.08 percent by mass, more preferably from 0.01 to 0.06 percent by mass, particularly preferably from 0.02 to 0.05 percent by mass with the objective of further enhancing anti-wear properties for metal materials and anti-shudder durability.

When the lubricating oil composition of the present invention contains a sulfonate detergent as Component (B), there is no particular restriction on the mass ratio of the content of the sulfonate detergent in terms of metal to the content of the phosphorus-containing anti-wear agent in terms of phosphorus. However, the mass ratio is preferably from 0.1 to 250, more preferably from 0.5 to 50, more preferably from 0.8 to 5, particularly preferably from 1 to 3 because it is rendered possible to produce a lubricating oil composition which is excellent in anti-wear properties and initial anti-shudder properties and can easily retain such anti-shudder properties for a long period of time.

Component (E) of the lubricating oil composition of the present invention is a viscosity index improver. Examples of the viscosity index improver include non-dispersant type viscosity index improvers such as copolymers of one or more monomers selected from various methacrylic acid esters or hydrogenated compounds of the copolymers, or dispersant type viscosity index improvers such as copolymers of various methacrylic acid esters further containing nitrogen compounds. Specific examples of other viscosity index improvers include non-dispersant- or dispersant-type ethylene-α-olefin copolymers of which the α-olefin may be propylene, 1-butene, or 1-pentene, or hydrogenated compounds thereof; polyisobutylenes or hydrogenated compounds of the copolymers; styrene-diene hydrogenated copolymers; styrene-maleic anhydride ester copolymers; and polyalkylstyrenes. The lubricating oil composition or the present invention may contain one or more compounds arbitrarily selected from these viscosity index improvers. However, the lubricating oil composition contains preferably a non-dispersant or dispersant type polymethacrylate, particularly preferably a non-dispersant type polymethacrylate.

The weight-average molecular weight (Mw) of Component (E) is importantly 50,000 or greater, preferably 60,000 or greater, more preferably 65,000 or greater. There is no particular restriction on the upper limit which is usually 1,000,000 or less. However, the upper limit is preferably 300,000 or less, more preferably 150,000 or less, more preferably 90,000 or less in view of excellent shear stability and with the objective of easily retaining initial anti-wear properties. Component (E) with a weight-average molecular weight (Mw) of less than 50,000 is not preferable because low temperature viscosity characteristics and anti-fatigue properties can not be enhanced sufficiently.

The content of Component (E) in the lubricating oil composition of the present invention is from 0.01 to 20 percent by mass, preferably from 5 to 15 percent by mass thereby enhancing the viscosity index, low temperature viscosity characteristics and anti-fatigue properties of the resulting composition sufficiently.

The lubricating oil composition of the present invention can exhibit excellent anti-wear properties and anti-fatigue properties due to the above-described components. However, in order to further enhance the performance of the lubricating oil composition of the present invention or provide the composition with necessary performances as a lubricating oil composition, it may be blended with known additives. Examples of such additives include ashless dispersants other than Component (C), extreme pressure additive other than Component (D), viscosity index improvers other than Component (E), friction modifiers, anti-oxidants, metal deactivators, rust inhibitors, corrosion inhibitors, pour point depressants, rubber swelling agents, anti-foaming agents, and dyes. These additives may be used alone or in combination.

Examples of ashless dispersants other than Component (C) include nitrogen-containing compounds such as benzylamines and polyamines, each having in their molecules at least one alkyl or alkenyl group having 40 to 400, preferably 60 to 350 carbon atoms, and derivatives or modified products thereof. The alkyl or alkenyl group having 40 to 400 carbon atoms may be straight-chain or branched and is preferably a branched alkyl or alkenyl group derived from an oligomer of an olefin such as propylene, 1-butene, or isobutylene, or a cooligomer of ethylene and propylene.

One or more types of these ashless dispersants may be blended in any amount in the lubricating oil composition of the present invention. However, the content of the ashless dispersants is from 0.1 to 10 percent by mass, preferably from 1 to 6 percent by mass, on the basis of the total amount of the composition.

Any compound that is usually used as an extreme pressure additive for a lubricating oil may be used as extreme pressure additives other than Component (E). Examples of such compounds include sulfur-containing compounds such as dithiocarbamates, sulfides, olefin sulfides, and sulfurized fats and oils. One or more types of these extreme pressure additives may be blended in any amount in the lubricating oil composition of the present invention. However, the content of the extreme pressure additives is usually from 0.01 to 5.0 percent by mass, on the basis of the total amount of the composition.

Specific examples of viscosity index improvers other than Component (E) include those with a weight average molecular weight of less than 50,000 selected from various viscosity index improvers exemplified with respect to Component (E).

When these viscosity index improvers other than Component (E) is blended, the content thereof may be any amount as long as the exhibition of the advantageous effects are not bothered and is usually from 0.1 to 20 percent by mass, preferably 5 percent by mass or less on the basis of the total amount of the lubricating oil composition of the present invention.

Friction modifiers may be any compound that is usually used as a friction modifier for a lubricating oil. Specific examples include amine-, imide-, amide-, and fatty acid-type friction modifiers, each having in their molecules at least one alkyl or alkenyl group having 6 to 30 carbon atoms, particularly a straight-chain alkyl or alkenyl group having 6 to 30 carbon atoms.

Examples of amine-type friction modifiers include those such as straight-chain or branched, preferably straight-chain aliphatic monoamines, alkanolamines, and aliphatic polyamines, each having 6 to 30 carbon atoms, and alkyleneoxide adducts of these aliphatic amines.

Examples of imide-type friction modifiers include succinimide-type friction modifiers such as mono and/or bis succinimides having one or two straight-chain or branched, preferably branched hydrocarbons having 6 to 30, preferably 8 to 18 carbon atoms, and succinimide-modified compounds obtained by allowing such succinimides to react with one or more compounds selected from boric acid, phosphorus acid, phosphoric acid, a carboxylic acid having 1 to 20 carbon atoms, and sulfur-containing compounds.

Examples of amide-type friction modifiers include fatty acid amide-type friction modifiers such as amides of straight-chain or branched, preferably straight-chain fatty acids having 7 to 31 carbon atoms and ammonia, aliphatic monoamines, or aliphatic polyamines.

Examples of fatty acid-type friction modifiers include straight-chain or branched, preferably straight-chain fatty acids, fatty acid esters of such fatty acids and aliphatic monohydric alcohols or aliphatic polyhydric alcohols, fatty acid metal salts such as alkaline earth metal salts of such fatty acids (magnesium and calcium salts) and zinc salts of such fatty acids.

In the present invention, the above-described imide-type friction modifiers, in particular succinimide-type friction modifiers are effective in significantly improving the anti-shudder durability.

One or more types of these friction modifiers may be blended in any amount in the lubricating oil composition of the present invention. However, the content of the friction modifiers is usually from 0.01 to 5.0 percent by mass, preferably from 0.03 to 3.0 percent by mass, on the basis of the total amount of the composition.

The anti-oxidants may be any of those generally used in a lubricating oil, such as phenolic or aminic compounds.

Specific examples of the anti-oxidants include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; esters of (3,5-di-tert-butyl-4-hydroxyphenyl)fatty acid (propionic acid) with a monohydric or polyhydric alcohol such as methanol, octadecanol, 1,6-hexanediol, neopentyl glycol, thiodiethylene glycol, triethylene glycol and pentaerythritol; phenothiazines; organic metal anti-oxidants such as molybdenum, copper, and zinc; and mixtures thereof.

One or more types of these anti-oxidants may be blended in any amount in the lubricating oil composition of the present invention. However, the content of the anti-oxidants is usually from 0.01 to 5.0 percent by mass, on the basis of the total amount of the composition.

Examples of metal deactivators include thiazole compounds and thiadiazole compounds. Preferably thiadiazole compounds are used. Examples of thiadiazole compounds include 2,5-bis(alkylthio)-1,3,4-thiadiazole having a straight-chain or branched alkyl group having 6 to 24 carbon atoms;

2,5-bis(alkyldithio)-1,3,4-thiadiazole having a straight-chain or branched alkyl group having 6 to 24 carbon atoms;

2-(alkylthio)-5-mercapto-1,3,4-thiadiazole having a straight-chain or branched alkyl group having 6 to 24 carbon atoms;

2-(alkyldithio)-5-mercapto-1,3,4-thiadiazole having a straight-chain or branched alkyl group having 6 to 24 carbon atoms, and mixtures thereof. Among these, particularly preferred are 2,5-bis(alkyldithio)-1,3,4-thiadiazoles. The content of these metal deactivators is from 0.005 to 0.5 percent by mass on the basis of the total amount of the composition.

Examples of rust inhibitors include alkenyl succinic acids, alkenyl succinic acid esters, polyhydric alcohol esters, petroleum sulfonates, and dinonylnaphthalene sulfonates.

Examples of corrosion inhibitors include benzotriazole-, tolyltriazole-, thiadiazole-, and imidazole-type compounds.

Examples of pour point depressants include polymethacrylate conforming with a lubricating base oil to be used.

Examples of rubber swelling agents include aromatic- or ester-type rubber swelling agents.

Examples of anti-foaming agents include silicones such as dimethylsilicone and fluorosilicone.

Although the contents of these additives are optional, the content of the corrosion inhibitor is from 0.005 to 0.2 percent by mass, the content of ant-foaming agent is from 0.0005 to 0.01 percent by mass, and the content of the other additives is from 0.005 to 10 percent by mass, on the basis of the total amount of the lubricating oil composition of the present invention.

The kinematic viscosity at 100° C. of the lubricating oil composition of the present invention is usually from 2 to 25 $mm^2/s$, preferably from 4 to 15 $mm^2/s$, more preferably from 5 to 10 $mm^2/s$, more preferably from 6.5 to 8 $mm^2/s$.

The viscosity index of the lubricating oil composition of the present invention is usually 160 or greater, preferably 180 or greater, more preferably 200 or greater.

The Brookfield viscosity at −40° C. of the lubricating oil composition of the present invention is preferably 15000 mPa·s or lower, more preferably 12000 mPa·s or lower, more preferably 10000 mPa·s or lower, particularly preferably 8000 mPa·s or lower.

The lubricating oil composition of the present invention is a lubricating oil composition with excellent anti-wear properties and anti-fatigue properties as well as excellent low temperature fluidity, particularly suitable for automatic transmissions and/or manual transmissions.

The lubricating oil composition of the present invention is also excellent in properties of transmission oils other than the above and thus suitably used as a lubricating oil for automatic transmissions or manual transmissions or differential gears of automobiles, construction machinery, or agricultural machinery. Other than these usages, the lubricating oil composition may also be used as a lubricating oil required to have anti-wear properties, anti-fatigue properties, and low temperature viscosity characteristics, for example, as a gear oil for industrial use, a lubricating oil for the gasoline engines, diesel engines, and gas engines of automobiles such as two- and four-wheeled vehicles, power generators, and ships, a turbine oil, and a compressor oil.

Hereinafter, the present invention will be described in more details by way of the following examples and comparative examples, which should not be construed as limiting the scope of the invention.

EXAMPLES 1 to 6 And COMPARATIVE EXAMPLES 1 to 5

Table 1 sets forth the properties of lubricating base oils A to G used in the Examples and Comparative Examples.

Lubricating oil compositions of Examples 1 to 6 according to the present invention (the kinematic viscosity at 100° C. of each composition was adjusted to about 7 $mm^2/s$) and those of Comparative Examples 1 to 5 for comparison were prepared as set forth in Table 2 and subjected to the following evaluation tests. The results are also set forth in Table 2. The ratio of each of the base oils is on the basis of the total amount of the base oil, and the content of each of the additives is on the basis of the total amount of the composition.

(1) Low Temperature Viscosity Characteristics

The Brookfield viscosity at −40° C. of each lubricating oil compositions was measured in accordance with ASTM D 2983. In this test, a composition with a lower Brookfield viscosity value is more excellent in low temperature fluidity.

(2) Anti-wear Properties

A high-speed four-ball test was conducted for each lubricating oil composition under the following conditions in accordance with JPI-5S-32-90 so as to measure the wear scar diameter after the test. A smaller scar diameter indicates that the composition is more excellent in anti-wear properties.

Load: 392N

Rotating speed: 1800 rpm

Test oil temperature: 75° C.

Test time: one hour (3) Anti-fatigue Properties

The life span till pitching occurs was evaluated for each composition under the following conditions using a high temperature rolling-contact fatigue test machine. A longer fatigue life (L50) indicates that the composition is more excellent in anti-fatigue properties.

Test piece: supported at three points by SUJ2 balls

Temperature: 120° C.

Load: 550 kgf

Rotating speed: 1500 rpm

As apparent from the results set forth in Table 2, the lubricating oil compositions of Examples 1 to 6 according to the present invention were excellent in low temperature viscosity characteristics, anti-wear properties, and anti-fatigue properties.

On the other hand, in the case where Component (A) was not used as a lubricating base oil and the base oil viscosity was adjusted to a low level to lower the low temperature viscosity characteristics (Comparative Example 1), the composition was poor in anti-wear properties and anti-fatigue properties. In the case where Component (A) was not used and the base oil viscosity was adjusted equally to that of Examples of the present invention (Comparative Example 2), the composition was extremely poor in low temperature viscosity characteristics. In the case where even though Component (A) was used, the Mw of Component (E) was less than 50,000 (Comparative Example 3), the composition was low in viscosity index and poor in anti-fatigue properties. In the case where no metallic detergent was contained (Comparative Example 4), the composition was extremely poor in anti-fatigue properties. In the case where no phosphorus-containing anti-wear agent was contained (Comparative Example 5), the composition was extremely poor in anti-wear properties. Further, in the case where a specific amount of a boron-containing succinimide-type ashless dispersant was used as Component (C), the composition was significantly improved in anti-wear properties and anti-fatigue properties (comparison between Examples 4 and 6).

TABLE 1

| | Base Oil A | Base Oil B | Base Oil C | Base Oil D | Base Oil E | Base Oil F | Base Oil G |
|---|---|---|---|---|---|---|---|
| Feedstock | Vacuum-distillate[1)] | Vacuum-distillate[1)] | Vacuum-distillate[2)] | Vacuum-distillate[1)] | Vacuum-distillate[1)] | Vacuum-distillate[2)] | [7)] |
| Refinining process | Hydro-cracking[3)] | Hydro-cracking[3)] | Solvent[4)] refining | Hydro-cracking[3)] | Hydro-cracking[3)] | Solvent refining[4)] | [7)] |
| Dewaxing process | Catalytic dewaxing[5)] | Solvent dewaxing[6)] | Solvent dewaxing[6)] | Catalytic dewaxing[5)] | Solvent dewaxing[6)] | Solvent dewaxing[6)] | — |
| Kinematic viscosity (100° C.) $mm^2/s$ | 3.3 | 2.6 | 2.0 | 4.3 | 4.1 | 4.4 | 1.7 |
| Viscosity index | 112 | 111 | 93 | 123 | 120 | 102 | 93 |
| Pour point ° C. | −22.5 | −27.5 | −25 | −17.5 | −22.5 | −15 | −45 |
| Aniline point ° C. | 109 | 104 | 87 | 116 | 112 | 99 | |
| Sulfur content mass ppm | <1 | <1 | 1000 | <1 | <1 | 1300 | <1 |
| Nitrogen content mass ppm | <3 | <3 | <3 | <3 | <3 | 6 | <3 |
| NOACK evaporation loss mass % | 34.5 | 52 | 90 | 14 | 17 | 21 | — |
| n-d-M analysis (in accordance with ASTM D 3238-85) | | | | | | | |
| % $C_P$ | 73 | 75 | 61 | 81 | 78 | 66 | — |
| % $C_N$ | 27 | 23 | 34 | 19 | 21 | 29 | — |
| % $C_A$ | 0 | 1 | 5 | 0 | 1 | 5 | — |
| % $C_P$/% $C_N$ | 2.6 | 3.3 | 1.8 | 4.2 | 3.8 | 2.3 | — |
| EI-MS analysis (in accordance with ASTM D 2786-91) Paraffins and naphthenes in the saturates | | | | | | | |
| Paraffins mass % | 51 | 64 | 45 | 54 | 53 | 34 | — |
| Naphthenes (1 to 6 rings) mass % | 49 | 36 | 55 | 46 | 47 | 66 | — |
| 1 ring naphthenes mass % | 19 | 16 | 15 | 20 | 17 | 16 | — |
| 2 to 6 ring naphthenes mass % | 30 | 20 | 40 | 26 | 30 | 50 | — |
| Paraffins + 1 ring naphthens mass % | 70 | 80 | 60 | 74 | 70 | 50 | — |
| Paraffins/1 ring naphthenes | 2.7 | 4.0 | 3.0 | 2.7 | 3.1 | 2.1 | — |

[1)]atmospheric distillation bottom from crude oil was subjected to vacuum-distillation and then desulfurization to be feedstock for hydrocracking

[2)]atmospheric distillation bottom from crude oil was subjected to vacuum-distillation and fractional distillation

[3)]process wherein aromatics, nitrogen compounds, sulfur compounds or the like were hydrocracked using a catalyst supporting a metal containing a Group VIII transitional metal as the main component

[4)]process containing a solvent refining process using a solvent such as furfural and hydrogenation refining process

[5)]dewaxing process wherein a part of wax components is decomposed and hydroisomerized

[6)]solvent dewaxing process with a solvent such as MEK or the like

[7)]oil obtained by hydrogenating an oligomer of α-olefin containing 1-decene as the main component

TABLE 2

| | Example 1 | Example 2 | Example 3 | Example 4 | Example 5 | Example 6 |
|---|---|---|---|---|---|---|
| Lubricating base oil (on the basis of total amount of base oil) mass % | | | | | | |
| (A) Base oil A[1)] | 90 | 75 | | 40 | | 40 |
| Base oil B[1)] | | | | | 40 | |
| Base oil C[1)] | | | | | | |
| Base oil D[1)] | 10 | 25 | 80 | 50 | | 50 |
| Base oil E[1)] | | | | | 60 | |
| Base oil F[1)] | | | | | | |
| Base oil G[1)] | | | 20 | 10 | | 10 |
| Kinematic viscosity of mixed base oil (100° C.) | 3.4 | 3.5 | 3.4 | 3.4 | 3.4 | 3.4 |
| Viscosity index of (A) mixed oil | 113 | 114 | 115 | 114 | 116 | 114 |
| Additives (on the basis of total amount of composition) mass % | | | | | | |
| (B) Metallic detergent A[2)] | 0.17 | 0.17 | 0.17 | 0.17 | 0.17 | 0.17 |
| Metallic detergent B[3)] | 0.33 | 0.33 | 0.33 | 0.33 | 0.33 | 0.33 |
| (C) Ashless dispersant A[4)] | 3.0 | 3.0 | 3.0 | 3.0 | 3.0 | 4.0 |
| Ashless dispersant B[5)] | 1.0 | 1.0 | 1.0 | 1.0 | 1.0 | |
| (D) Phosphorus anti-wear agent A[6)] | 0.2 | 0.2 | 0.2 | 0.2 | 0.2 | 0.2 |
| (E) Polymethacrylate A[7)] | 10.0 | 9.0 | 9.5 | 9.5 | 10.0 | 9.5 |
| Polymethacrylate B[8)] | | | | | | |
| Package of other additives[9)] | 0.76 | 0.76 | 0.76 | 0.76 | 0.76 | 0.76 |
| Ca amount derived from (B) mass % | 0.05 | 0.05 | 0.05 | 0.05 | 0.05 | 0.05 |
| P amount derived from (C) mass % | 0.03 | 0.03 | 0.03 | 0.03 | 0.03 | 0.03 |
| Product viscosity (100° C.) | 7.1 | 6.9 | 7.2 | 7.2 | 7.1 | 7.2 |
| Viscosity index | 216 | 208 | 212 | 211 | 217 | 211 |
| Low temperature viscosity (−40° C.) mPa · s | 7800 | 8100 | 6500 | 7600 | 11300 | 7600 |
| Anti-wear properties mm | 0.38 | 0.36 | 0.37 | 0.35 | 0.38 | 0.42 |
| Fatigue life (L50) h | 13.5 | 12.5 | 13.0 | 13.3 | 11.8 | 10.0 |

TABLE 2-continued

| | Comparative Example 1 | Comparative Example 2 | Comparative Example 3 | Comparative Example 4 | Comparative Example 5 |
|---|---|---|---|---|---|
| Lubricating base oil (on the basis of total amount of base oil) mass % | | | | | |
| (A) Base oil A[1)] | | | 90 | 90 | 90 |
| Base oil B[1)] | | | | | |
| Base oil C[1)] | 50 | 25 | | | |
| Base oil D[1)] | | | 10 | 10 | 10 |
| Base oil E[1)] | | | | | |
| Base oil F[1)] | 50 | 75 | | | |
| Base oil G[1)] | | | | | |
| Kinematic viscosity of mixed base oil (100° C.) | 2.9 | 3.5 | 3.4 | 3.4 | 3.4 |
| Viscosity index of (A) mixed oil | 95 | 99 | 113 | 113 | 113 |
| Additives (on the basis of total amount of composition) mass % | | | | | |
| (B) Metallic detergent A[2)] | 0.17 | 0.17 | 0.17 | — | 0.17 |
| Metallic detergent B[3)] | 0.33 | 0.33 | 0.33 | — | 0.33 |
| (C) Ashless dispersant A[4)] | 3.0 | 3.0 | 3.0 | 3.0 | 3.0 |
| Ashless dispersant B[5)] | 1.0 | 1.0 | 1.0 | 1.0 | 1.0 |
| (D) Phosphorus anti-wear agent A[6)] | 0.2 | 0.2 | 0.2 | 0.2 | — |
| (E) Polymethacrylate A[7)] | 15.0 | 9.0 | | 10.0 | 10.0 |
| Polymethacrylate B[8)] | | | 5.0 | | |
| Package of other additives[9)] | 0.76 | 0.76 | 0.76 | 0.76 | 0.76 |
| Ca amount derived from (B) mass % | 0.05 | 0.05 | 0.05 | 0.00 | 0.05 |
| P amount derived from (C) mass % | 0.03 | 0.03 | 0.03 | 0.03 | 0.00 |
| Product viscosity (100° C.) | 7.3 | 7.2 | 5.4 | 7.1 | 7.1 |
| Viscosity index | 225 | 195 | 160 | 216 | 216 |
| Low temperature viscosity (−40° C.) mPa · s | 8500 | 17000 | 9500 | — | — |
| Anti-wear properties mm | 0.50 | 0.34 | 0.38 | — | 0.68 |
| Fatigue life (L50) h | 9.0 | 13.5 | 9.0 | 5.0 | — |

[1)]Base oils A to G: see Table 1

[2)]Calcium carbonate overbased salt of alkylsalicylic acid calcium salt having C14 to C18 secondary alkyl group (Base number 170 mgKOH/g, Ca: 6 mass %) Structure of alkylsalicylic carbonate: 3-alkyl: 53 mol %, 4-alkyl: 4 mol %, 5-alkyl: 35 mol %, 3,5-dialkyl: 8 mol %

[3)]Calcium sulfonate (Total base number: 300 mgKOH/g, Ca: 12 mass %),

[4)]polybutenyl succinimide (N content: 2.0 mass %)

[5)]Borated polybutenyl succinimide (N content: 2.3%, B content: 2.0%, B/N ratio: 0.87),

[6)]dibutylphosphite (phosphorus content: 16.4 mass %)

[7)]Non-dispersant type polymethacrylate (molecular weight: 70,000),

[8)]Non-dispersant type polymethacrylate (molecular weight: 20,000)

[9)]Friction modifier, anti-oxidant, corrosion inhibitor, rubber swelling agent, and anti-foaming agent

The invention claimed is:

1. A lubricating oil composition comprising:

(A) a base oil with a kinematic viscosity at 100° C. of 1 to 8 $mm^2/s$, a pour point of −15° C. or lower an aniline point of 100° C. or higher, and a viscosity index of 100 to 135, the saturates of the base oil containing 40 to 57 percent by mass of paraffins and 43 to 60 percent by mass of naphthenes, wherein a mass ratio of one ring naphthenes to two to six ring naphthenes is 0.77 or less, as the main component; and on the basis of the total amount of the composition:

(B) 0.005 to 0.4 percent by mass of a metallic detergent;

(C) 0.005 to 0.2 percent by mass in terms of nitrogen of a succinimide-type ashless dispersant;

(D) 0.005 to 0.2 percent by mass in terms of phosphorus of a phosphorus-containing anti-wear agent; and (E) 0.01 to 20 percent by mass of a viscosity index improver with a weight average molecular weight (Mw) of 50,000 or greater;

wherein a viscosity index of the composition is 160 or greater.

2. The lubricating oil composition according to claim 1, wherein Component (A) is a base oil, the total content of the paraffins and one ring naphthenes in the saturates of the base oil being 65 percent by mass or more.

3. The lubricating oil composition according to claim 2, wherein the composition contains a base oil fulfilling the requirements of Component (A), the ratio of the paraffins and one ring naphthenes (paraffins/one single ring naphthenes) in the saturates of the base oil being 3.5 or less.

4. The lubricating oil composition according to claim 1, wherein the composition contains a base oil fulfilling the requirements of Component (A), the base oil being produced by a process including a catalytic dewaxing process.

5. The lubricating oil composition according to claim 1, further comprising a poly-α-olefin base oil.

6. The lubricating oil composition according to claim 1, wherein Component (B) contains an alkaline earth metal salicylate.

7. The lubricating oil composition according to claim 1, wherein Component (C) contains a boron-containing succinimide-type ashless dispersant, the content thereof being from 0.001 to 0.2 percent by mass in terms of boron on the basis of the total amount of the composition.

8. The lubricating oil composition according to claim 1, wherein Component (B) is selected from the group consisting of phosphoric acid, phosphorus acid, phosphoric acid esters and phosphorus acid ester, each having a hydrocarbon group having 1 to 30 carbon atoms, and derivatives thereof.

* * * * *